US009471023B2

(12) United States Patent
Sasami

(10) Patent No.: US 9,471,023 B2
(45) Date of Patent: Oct. 18, 2016

(54) IMAGE FORMING DEVICE, IMAGE FORMING METHOD, AND IMAGE FORMING PROGRAM

(71) Applicant: KONICA MINOLTA INC., Chiyoda-ku, Tokyo (JP)

(72) Inventor: Shingo Sasami, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/558,335

(22) Filed: Dec. 2, 2014

(65) Prior Publication Data

US 2015/0168902 A1 Jun. 18, 2015

(30) Foreign Application Priority Data

Dec. 13, 2013 (JP) ..... 2013-258110

(51) Int. Cl.
*G03G 15/00* (2006.01)

(52) U.S. Cl.
CPC ..... *G03G 15/652* (2013.01); *G03G 15/5054* (2013.01); *G03G 2215/0135* (2013.01); *G03G 2215/0164* (2013.01)

(58) Field of Classification Search
CPC ..... G03G 15/5025; G03G 15/652; G03G 15/5062; G03G 15/5041; G03G 15/5054; G03G 15/5058; G03G 2215/652; G03G 2215/6526; G03G 2215/00223; G03G 2215/00227
USPC ..... 399/49, 72, 384
See application file for complete search history.

(56) References Cited

U.S. PATENT DOCUMENTS

| | | | | |
|---|---|---|---|---|
| 4,542,985 | A * | 9/1985 | Honma et al. | 355/69 |
| 5,708,915 | A * | 1/1998 | Noguchi et al. | 399/49 |
| 5,839,016 | A * | 11/1998 | Folkins et al. | 399/46 |
| 8,045,871 | B2 | 10/2011 | Monma et al. | |
| 8,514,468 | B2 | 8/2013 | Goto | |
| 2008/0034996 | A1 | 2/2008 | Yamamoto | |
| 2009/0208267 | A1* | 8/2009 | Matsuduki | 399/390 |
| 2010/0141975 | A1* | 6/2010 | Takaki | 358/1.12 |
| 2015/0078771 | A1* | 3/2015 | Tanigami et al. | 399/45 |

FOREIGN PATENT DOCUMENTS

| | | | |
|---|---|---|---|
| JP | 2006084796 | A | 3/2006 |
| JP | 2007279327 | A | 10/2007 |
| JP | 2008044206 | A | 2/2008 |
| JP | 2010008436 | A | 1/2010 |
| JP | 2011149980 | A | 8/2011 |

OTHER PUBLICATIONS

Japanese Office Action (and English translation thereof) dated Dec. 8, 2015, issued in counterpart Japanese Application No. 2013-258110.

* cited by examiner

*Primary Examiner* — David Gray
*Assistant Examiner* — Trevor J Bervik
(74) *Attorney, Agent, or Firm* — Holtz, Holtz & Volek PC

(57) ABSTRACT

An image forming device includes an image forming unit configured to continuously form images on continuous paper, a conveying unit configured to convey the continuous paper, and a control unit configured to start an image quality adjusting operation for adjusting image quality of a subsequent image to be formed by the image forming unit after formation of a last image by the image forming unit is completed while the conveying unit conveys the continuous paper until the last image arrives at a predetermined position.

24 Claims, 7 Drawing Sheets

IMAGE FORMING DEVICE, IMAGE FORMING METHOD, AND IMAGE FORMING PROGRAM

The entire disclosure of Japanese Patent Application No. 2013-258110 filed on Dec. 13, 2013 including description, claims, drawings, and abstract are incorporated herein by reference in its entirety.

BACKGROUND OF THE INVENTION

1. Field of the Invention

The present invention relates to an image forming device, an image forming method, and an image forming program.

2. Description of the Related Art

Conventionally, there is an image forming device capable of using continuous paper (including roll paper) as a recording medium. In such image forming device, when the continuous paper is conveyed to a position of an image forming unit, a toner image formed by the image forming unit is transferred to the continuous paper. Thereafter, the continuous paper is wound in a roll shape through a fixing device and a post-processing device to be stopped.

The image forming device conveys the continuous paper after the toner image is transferred to the continuous paper until conveyance of the continuous paper is stopped. It might take a long time of several tens of seconds or longer for an operation to convey the continuous paper depending on a configuration of the image forming device.

On the other hand, in a general image forming device, an image quality adjusting operation for adjusting image quality such as to create a toner band or to form a patch is performed. Such image quality adjusting operation is often performed when printing is started. There also is the image forming device which performs the image quality adjusting operation while the image forming device is idle or to perform the same with an increased gap between the images continuously printed on the continuous paper (refer to JP 2006-84796 A, for example).

In the conventional image forming device, another process is not accepted while the continuous paper is conveyed or the image quality adjusting operation is performed, so that system stopping time (down-time) becomes longer and productivity is deteriorated. Especially, when the image quality adjusting operation is performed with the increased gap between the images printed on the continuous paper, the continuous paper is wasted, so that the continuous paper cannot be efficiently used. When all the image quality adjusting operations are performed when the printing is started, the productivity is deteriorated and in addition, an operation based on an instruction from a user is started with delay, so that this gives the user a bad impression.

SUMMARY OF THE INVENTION

The present invention is achieved in view of the above-described circumstances and an object thereof is to provide an image forming device, an image forming method, and an image forming program capable of shortening the down-time occurring when the continuous paper is used as the recording medium and improving the productivity as compared to the conventional ones.

(1) To achieve at least one of the abovementioned objects, according to an aspect, an image forming device reflecting one aspect of the present invention comprises: an image forming unit configured to continuously form images on continuous paper; a conveying unit configured to convey the continuous paper; and a control unit configured to start an image quality adjusting operation for adjusting image quality of a subsequent image to be formed by the image forming unit after formation of a last image by the image forming unit is completed while the conveying unit conveys the continuous paper until the last image arrives at a predetermined position.

(2) The image forming device according to (1) described above, wherein the control unit preferably executes the image quality adjusting operation by controlling the image forming unit.

(3) The image forming device according to (1) or (2) described above, wherein the control unit preferably executes at least one of toner band creation, density correction, and color registration adjustment as the image quality adjusting operation.

(4) The image forming device according to any one of (1) to (3) described above, wherein the image forming unit preferably includes a transfer unit which transfers an image from an image carrying body to the continuous paper, and the control unit preferably separates the transfer unit from the continuous paper while the image quality adjusting operation is executed.

(5) The image forming device according to any one of (1) to (4) described above, wherein the control unit preferably determines whether a predetermined execution condition is satisfied for each of a plurality of image quality adjusting operations and executes the image quality adjusting operation the predetermined execution condition of which is satisfied.

(6) The image forming device according to any one of (1) to (5) described above, wherein, when there is the image quality adjusting operation being executed when the last image arrives at the predetermined position and conveyance of the continuous paper is stopped, the control unit preferably executes the image quality adjusting operation to the end and postpones the image quality adjusting operation not yet started without executing.

(7) The image forming device according to any one of (1) to (5) described above, wherein, when next image formation is reserved and there is the image quality adjusting operation being executed when the last image arrives at the predetermined position and conveyance of the continuous paper is stopped, the control unit preferably executes the image quality adjusting operation to the end and postpones the image quality adjusting operation not yet started without executing.

(8) The image forming device according to (6) or (7) described above, wherein the control unit preferably executes the image quality adjusting operation the execution of which is postponed when image formation by the image forming unit is newly started.

(9) The image forming device according to (6) or (7) described above, wherein the control unit preferably executes the image quality adjusting operation the execution of which is postponed when the next image formation by the image forming unit is finished.

(10) The image forming device according to (8) or (9) described above, wherein the control unit preferably preferentially executes the image quality adjusting operation the execution of which is postponed when there is a plurality of image quality adjusting operations which should be executed.

(11) To achieve at least one of the abovementioned objects, according to an aspect, an image forming method reflecting one aspect of the present invention comprises steps of: (a) continuously forming images on continuous paper; (b) conveying the continuous paper; and (c) starting an image quality adjusting operation for adjusting image quality of an image to be formed afterward after formation of a last image by the step (a) is completed while the continuous paper is conveyed by the step (b) until the last image arrives at a predetermined position.

(12) The image forming method according to (11) described above, wherein the step (c) preferably executes the image quality adjusting operation by controlling a device which performs the step (a).

(13) The image forming method according to (11) or (12) described above, wherein the step (c) preferably executes at least one of toner band creation, density correction, and color registration adjustment as the image quality adjusting operation.

(14) The image forming method according to any one of (11) to (13) described above, wherein the step (a) preferably includes a step of transferring an image from an image carrying body to the continuous paper by a transfer unit, and the step (c) preferably separates the transfer unit from the continuous paper while the image quality adjusting operation is executed.

(15) The image forming method according to any one of (11) to (14) described above, wherein the step (c) preferably determines whether a predetermined execution condition is satisfied for each of a plurality of image quality adjusting operations and executes the image quality adjusting operation the predetermined execution condition of which is satisfied.

(16) The image forming method according to any one of (11) to (15) described above, wherein, when there is the image quality adjusting operation being executed when the last image arrives at the predetermined position and conveyance of the continuous paper is stopped, the step (c) preferably executes the image quality adjusting operation to the end and postpones the image quality adjusting operation not yet started without executing.

(17) The image forming method according to any one of (11) to (15) described above, wherein, when next image formation is reserved and there is the image quality adjusting operation being executed when the last image arrives at the predetermined position and conveyance of the continuous paper is stopped, the step (c) preferably executes the image quality adjusting operation to the end and postpones the image quality adjusting operation not yet started without executing.

(18) The image forming method according to (16) or (17) described above, wherein the step (c) preferably executes the image quality adjusting operation the execution of which is postponed when image formation by the step (a) is newly started.

(19) The image forming method according to (16) or (17) described above, wherein the step (c) preferably executes the image quality adjusting operation the execution of which is postponed when the next image formation by the step (a) is finished.

(20) The image forming method according to (18) or (19) described above, wherein the step (c) preferably preferentially executes the image quality adjusting operation the execution of which is postponed when there is a plurality of image quality adjusting operations which should be executed.

(21) To achieve at least one of the abovementioned objects, according to an aspect, a non-transitory recording medium storing a computer readable program, reflecting one aspect of the present invention, which forms an image and allows a computer to execute steps of: (a) continuously forming images on continuous paper; (b) conveying the continuous paper; and (c) starting an image quality adjusting operation for adjusting image quality of an image to be formed afterward after formation of a last image by the step (a) is completed while the continuous paper is conveyed by the step (b) until the last image arrives at a predetermined position.

(22) The non-transitory recording medium storing a computer readable program which forms an image according to (21) described above, wherein the step (c) preferably executes the image quality adjusting operation by controlling a device which performs the step (a).

(23) The non-transitory recording medium storing a computer readable program which forms an image according to (21) or (22) described above, wherein the step (c) preferably executes at least one of toner band creation, density correction, and color registration adjustment as the image quality adjusting operation.

(24) The non-transitory recording medium storing a computer readable program which forms an image according to any one of (21) to (23) described above, wherein the step (a) preferably includes a step of transferring an image from an image carrying body to the continuous paper by a transfer unit, and the step (c) preferably separates the transfer unit from the continuous paper while the image quality adjusting operation is executed.

(25) The non-transitory recording medium storing a computer readable program which forms an image according to any one of (21) to (24) described above, wherein the step (c) preferably determines whether a predetermined execution condition is satisfied for each of a plurality of image quality adjusting operations and executes the image quality adjusting operation the predetermined execution condition of which is satisfied.

(26) The non-transitory recording medium storing a computer readable program which forms an image according to any one of (21) to (25) described above, wherein, when there is the image quality adjusting operation being executed when the last image arrives at the predetermined position and conveyance of the continuous paper is stopped, the step (c) preferably executes the image quality adjusting operation to the end and postpones the image quality adjusting operation not yet started without executing.

(27) The non-transitory recording medium storing a computer readable program which forms an image according to any one of (21) to (25) described above, wherein, when next image formation is reserved and there is the image quality adjusting operation being executed when the last image arrives at the predetermined position and conveyance of the continuous paper is stopped, the step (c) preferably executes the image quality adjusting operation to the end and postpones the image quality adjusting operation not yet started without executing.

(28) The non-transitory recording medium storing a computer readable program which forms an image according to (26) or (27) described above, wherein the step (c) preferably executes the image quality adjusting operation the execution of which is postponed when image formation by the step (a) is newly started.

(29) The non-transitory recording medium storing a computer readable program which forms an image according to (26) or (27) described above, wherein the step (c) preferably executes the image quality adjusting operation the execution of which is postponed when the next image formation by the step (a) is finished.

(30) The non-transitory recording medium storing a computer readable program which forms an image according to

(28) or (29) described above, wherein the step (c) preferably preferentially executes the image quality adjusting operation the execution of which is postponed when there is a plurality of image quality adjusting operations which should be executed.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

Meanwhile, the same reference sign is assigned to the same component in the description of the drawings and the overlapped description is omitted. A dimension ratio of the drawings is exaggerated for convenience of the description and might be different from an actual ratio.

Figure 1:
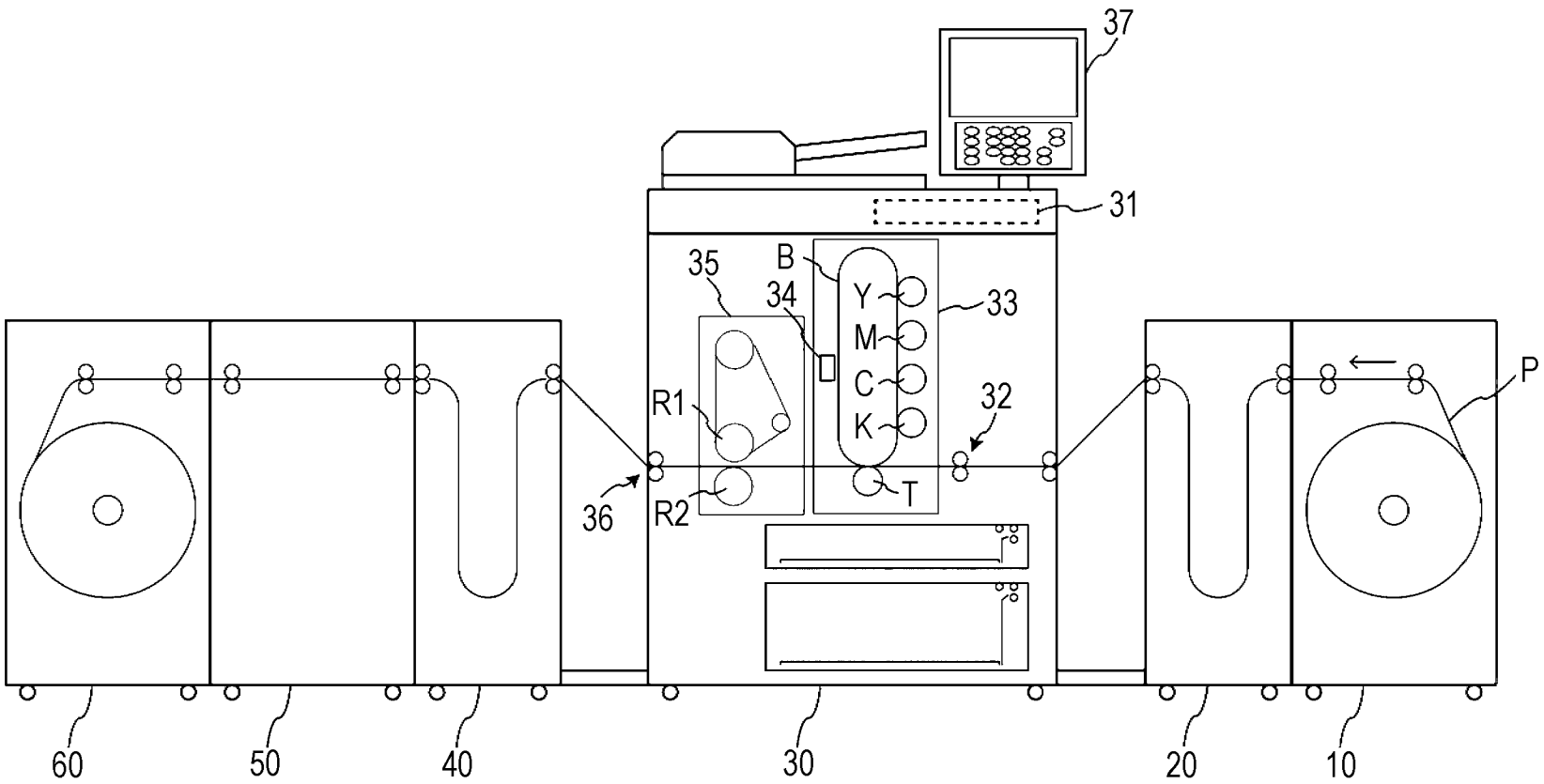
FIG. 1 is a view illustrating a schematic configuration example of an image forming system according to this embodiment.

FIG. 1 is a view illustrating a schematic configuration example of an image forming system according to this embodiment.

A schematic configuration of an image forming system 1 is hereinafter described with reference to FIG. 1.

<Image Forming System 1>

The image forming system 1 according to this embodiment is a system which uses continuous paper (including roll paper) as a recording medium to form an image on the continuous paper.

As illustrated in FIG. 1, the image forming system 1 is formed of a paper feeding device 10, a paper feed adjusting device 20, an image forming device 30, a paper ejection adjusting device 40, a processing device 50, and a paper ejecting device 60 connected in this order from an upstream side in a conveying direction of the continuous paper.

The paper feeding device 10 is a device which feeds continuous paper P to the image forming device 30. In a casing of the paper feeding device 10, as illustrated in FIG. 1, for example, roll-shaped continuous paper P is wound around a supporting shaft to be rotatably held. The paper feeding device 10 conveys the continuous paper P wound around the supporting shaft to outside at a constant speed through a plurality of rollers (for example, a delivery roller and a paper feeding roller). The continuous paper P is not necessarily required to be held in a roll shape but may be held in a folded manner in the paper feeding device 10. Although only a sheet of continuous paper P is illustrated in FIG. 1, a plurality of sheets of continuous paper may also be held.

The paper feed adjusting device 20 is located downstream of the paper feeding device 10 and upstream of the image forming device 30 in the conveying direction of the continuous paper P. The paper feed adjusting device 20 conveys the continuous paper P conveyed from the paper feeding device 10 to the image forming device 30. The paper feed adjusting device 20 loosely holds the continuous paper P as illustrated in FIG. 1 so as to absorb difference between a conveying speed of the continuous paper P in the paper feeding device 10 and the conveying speed of the continuous paper P in the image forming device 30, thereby adjusting paper feed of the continuous paper P to the image forming device 30.

The image forming device 30 has a print function. The image forming device 30 is located downstream of the paper feed adjusting device 20 and upstream of the paper ejection adjusting device 40 in the conveying direction of the continuous paper P. As illustrated in FIG. 1, the image forming device 30 is provided with a control unit 31, a paper feed conveying unit 32, an image forming unit 33, a reading unit 34, a fixing unit 35, a paper ejection conveying unit 36, and an operation panel 37.

The control unit 31 controls the units 32 to 36 included in the image forming device 30 to allow them to execute an operation to continuously form images on the continuous paper P (hereinafter, also referred to as an "image forming operation"). The control unit 31 controls the units 32 to 36 and the like included in the image forming device 30 to allow them to execute an operation to adjust image quality of the image formed on the continuous paper P (hereinafter, also referred to as an "image quality adjusting operation"). Meanwhile, the image quality adjusting operation is started after formation of a last image by the image forming operation is completed and before the last image is conveyed to a predetermined position (for example, in the paper ejecting device 60).

The image quality adjusting operation includes at least one of toner band creation, density correction, normal color registration adjustment, and fine color registration adjustment. Herein, the toner band creation is an operation to supply a slight amount of toner to a cleaning blade (not illustrated) for cleaning an image carrying body. The density correction is an operation to correct densities of respective colors (C, M, Y, and K) (density deviation) by changing a process condition such as an exposure amount and a bias voltage in the image forming operation. The normal color registration adjustment is an operation to adjust printing positions of the respective colors (color deviation) by changing a position at which irradiation of laser light applied to the image carrying bodies of the respective colors is started and an axis thereof. The fine color registration adjustment is an operation to adjust the printing positions of the respective colors by changing only the position at which the irradiation of the laser light applied to the image carrying bodies of the respective colors is started. Meanwhile, specific operations of the toner band creation, the density correction, the normal color registration adjustment, and the fine color registration adjustment are described later.

The paper feed conveying unit 32 which is a conveying mechanism on a paper feed side of the image forming device 30 allows a pair of paper feed conveying rollers to rotate by driving of a paper feed motor to convey the continuous paper P conveyed from the paper feed adjusting device 20 to the image forming unit 33.

The image forming unit 33 forms a toner image by an electrophotographic process and transfers the same to the continuous paper P. For example, in the image forming unit 33, photoreceptor drums (Y, M, C, and K) and an intermediate transfer belt B are used as the image carrying bodies. The intermediate transfer belt B being an endless belt is wound and supported so as to be runnable by a plurality of rollers. The toner images of the respective colors formed on the photoreceptor drums (Y, M, C, and K) are sequentially transferred to the intermediate transfer belt B and the toner image (color image) obtained by superposition of layers of the respective colors (Y, M, C, and K) is formed on the intermediate transfer belt B. The toner image formed on the intermediate transfer belt B is transferred to the continuous paper P by application of bias of opposite polarity to the toner to a transfer roller (transfer unit) T. In this manner, the image is formed on the continuous paper P.

The reading unit 34 is an image sensor which reads a patch and a pattern for image quality adjustment formed on the intermediate transfer belt B by the image forming unit 33. A reading result by the reading unit 34 is fed back to the image forming operation, the image quality adjusting operation and the like by the image forming unit 33.

The fixing unit 35 fixes the toner image transferred to the continuous paper P. For example, the fixing unit 35 compresses a fixing roller R1 being a heat source to a pressurizing roller R2. According to this, heat and pressure are applied to the continuous paper P at a nipping unit and the toner image is melt-fixed.

The paper ejection conveying unit 36 which is a conveying mechanism on a paper ejection side of the image forming device 30 allows a pair of paper ejection conveying rollers to rotate by driving of a paper ejection motor to convey the continuous paper P which passes through the fixing unit 35 to the paper ejection adjusting device 40.

The operation panel 37 is provided with a touch panel, a numeric keypad, a start button, a stop button and the like and is used for displaying various pieces of information and inputting various instructions.

Meanwhile, the image forming device 30 may also be an MFP (multi-function peripheral) having a copy function, a scan function, a facsimile function and the like in addition to the print function.

The paper ejection adjusting device 40 is located downstream of the image forming device 30 and upstream of the processing device 50 in the conveying direction of the continuous paper P. The paper ejection adjusting device 40 conveys the continuous paper P conveyed from the image forming device 30 to the processing device 50. The paper ejection adjusting device 40 loosely holds the continuous paper P as illustrated in FIG. 1 so as to absorb difference between the conveying speed of the continuous paper P in the image forming device 30 and the conveying speed of the continuous paper P in the processing device 50, thereby adjusting paper ejection of the continuous paper P from the image forming device 30.

The processing device 50 cuts out a predetermined shape from the continuous paper P or laminates the continuous paper P.

The paper ejecting device 60 is a device which ejects the continuous paper P conveyed from the image forming device 30 through the paper ejection adjusting device 40 and the processing device 50. In a casing of the paper ejecting device 60, as illustrated in FIG. 1, for example, the continuous paper P is wound around a supporting shaft to be held in the roll shape. For this, the paper ejecting device 60 winds the continuous paper P conveyed from the processing device 50 around the supporting shaft at a constant speed through a plurality of rollers (for example, a delivery roller and a paper ejecting roller). In the paper ejecting device 60, the continuous paper P is not necessarily required to be held in the roll shape but may be cut by page.

<Control Unit 31 (Hardware Configuration)>

Figure 2:
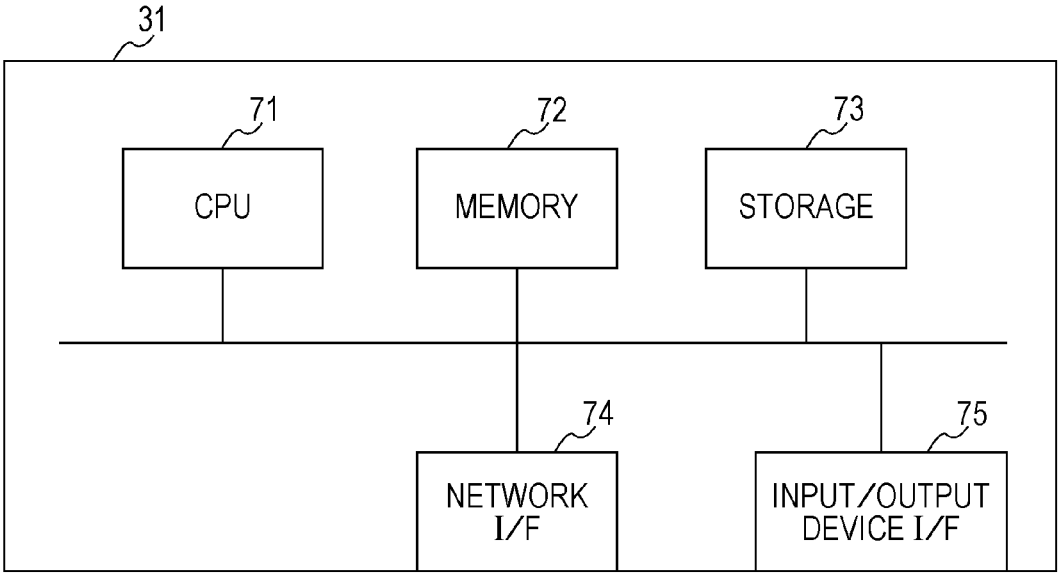
FIG. 2 is a block diagram illustrating a hardware configuration example of a control unit.

FIG. 2 is a block diagram illustrating an example of a hardware configuration of the control unit.

The hardware configuration of the control unit 31 is hereinafter described with reference to FIG. 2.

The control unit 31 includes a CPU (central processing unit) 71, a memory 72, a storage 73, a network interface (I/F) 74, and an input/output device interface (I/F) 75 and they are connected to one another through a bus for exchanging signals as illustrated in FIG. 2.

The CPU 71 is a control circuit formed of a multi-core processor and the like which controls the above-described units and executes various pieces of arithmetic processing according to a program, and each function of the image forming system 1 is exerted by the CPU 71 executing the program corresponding to this.

The memory 72 is a high-speed accessible main storage device which temporarily stores the program and data as a working area. A DRAM (dynamic random access memory), an SDRAM (synchronous dynamic random access memory), an SRAM (static random access memory) and the like are adopted, for example, as the memory 72.

The storage 73 is a large-capacity auxiliary storage device which stores various programs including an operating system and various data. A flash memory, a solid-state drive, a hard disk, a ROM (read only memory) and the like are adopted, for example, as the storage 73.

The network I/F 74 is an interface for communicating with another external device (for example, a host device in which a printer driver is embedded) through a computer network. Standards such as Ethernet™, Wi-Fi, FDDI, and token ring are used in the communication.

The input/output device I/F 75 is an interface for communicating with an input device such as the operation panel 37 and an output device, for example.

The control unit 31 of this embodiment has the above-described hardware configuration. By the hardware configuration, the control unit 31 controls to start the image quality adjusting operation after the formation of the last image by the image forming unit 33 is completed while the paper ejection conveying unit 36 conveys the continuous paper P until the last image arrives at a predetermined position (for example, in the paper ejecting device 60).

The operation of the image forming system 1 (especially, the control unit 31) is hereinafter described in detail.

<Operation of Image Forming System 1>

Figure 3:
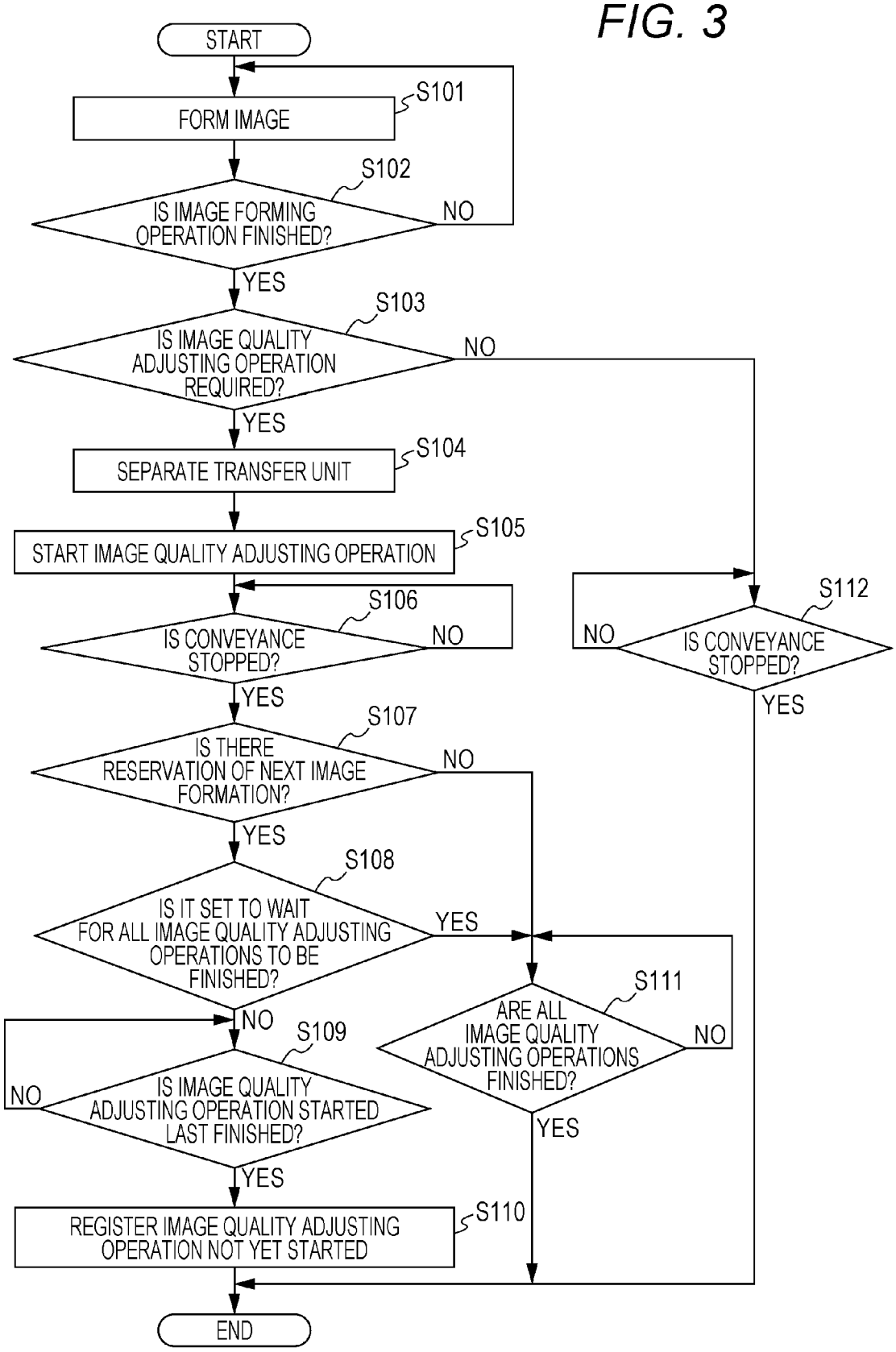
FIG. 3 is a flowchart illustrating a procedure of a determining process when printing is finished.
Figure 4:
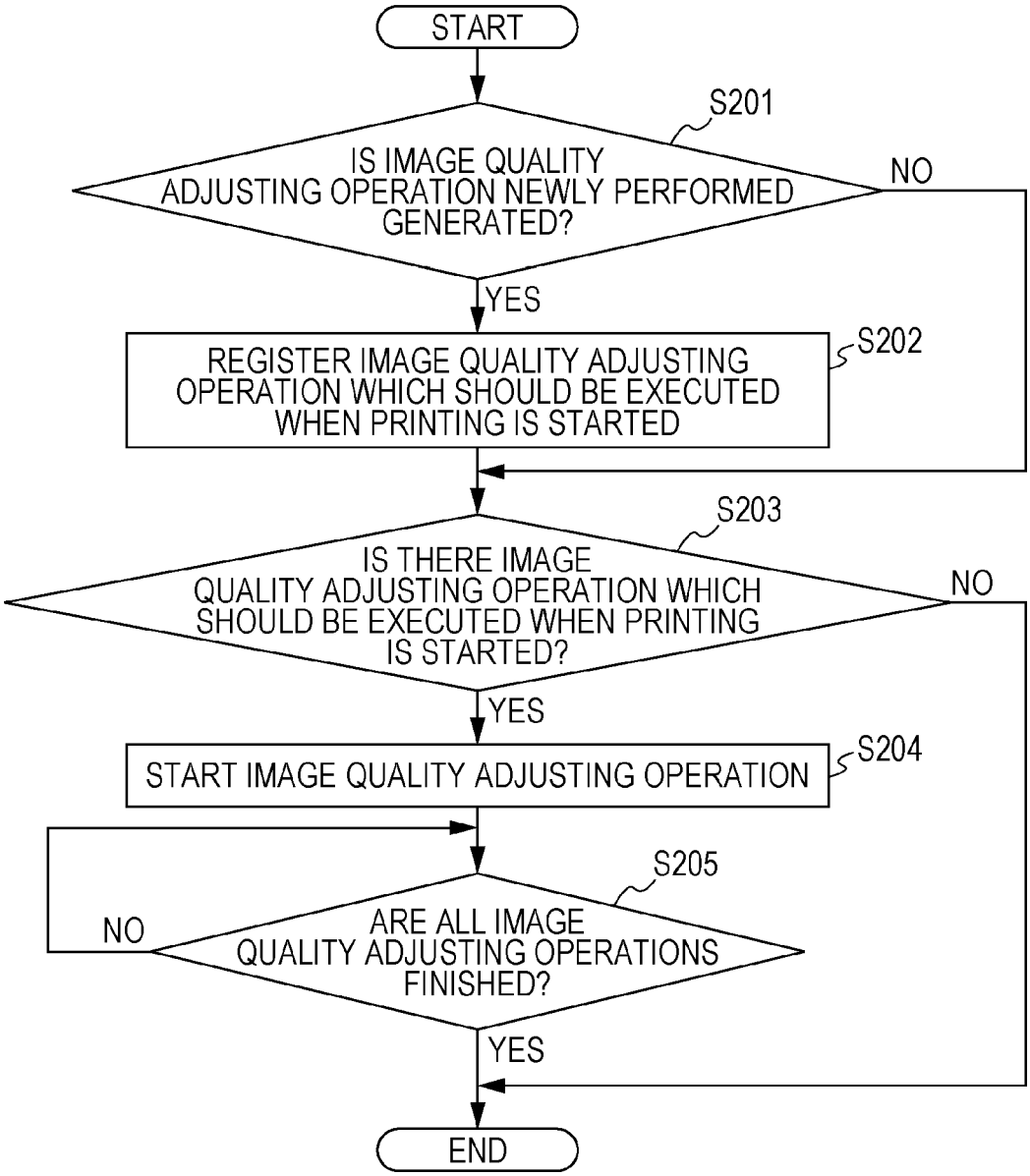
FIG. 4 is a flowchart illustrating a procedure of a determining process before the printing is started.
Figure 5:
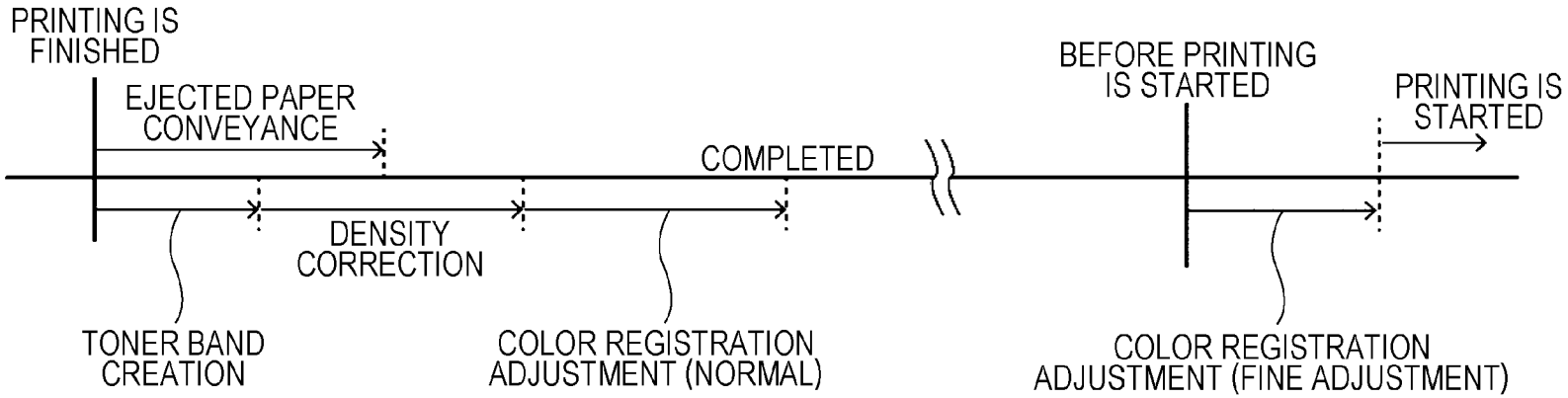
FIG. 5 is a view for illustrating an example in which all image quality adjusting operations are finished when the printing is finished.
Figure 6:
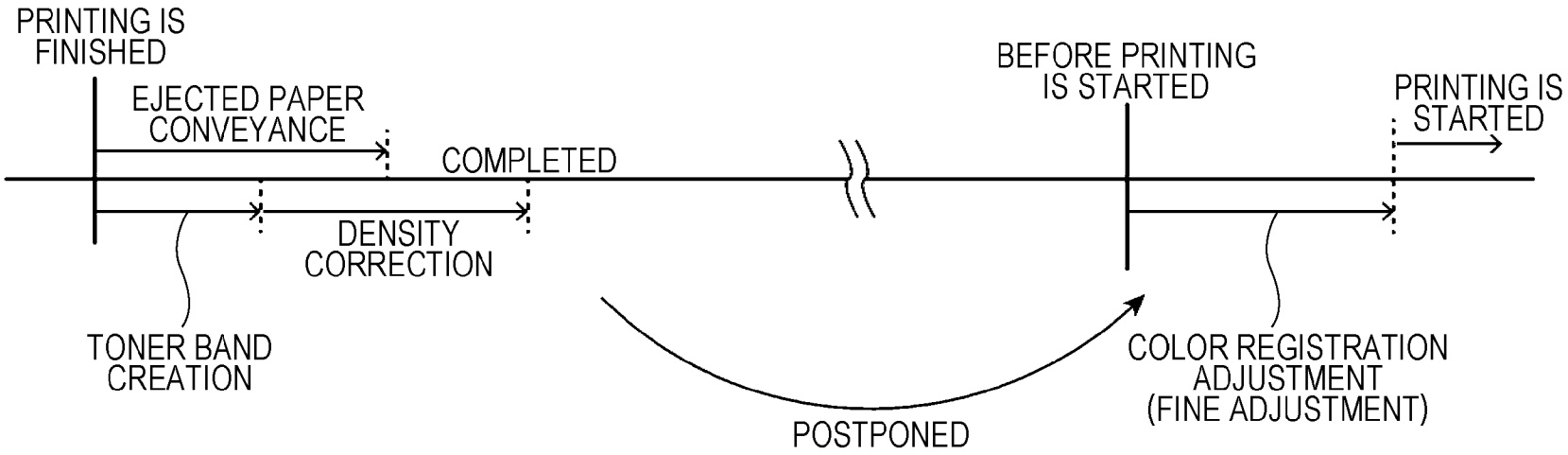
FIG. 6 is a view for illustrating an example in which the image quality adjusting operation not yet started when conveyance of the continuous paper is stopped is postponed to the time when next printing is started.
Figure 7:
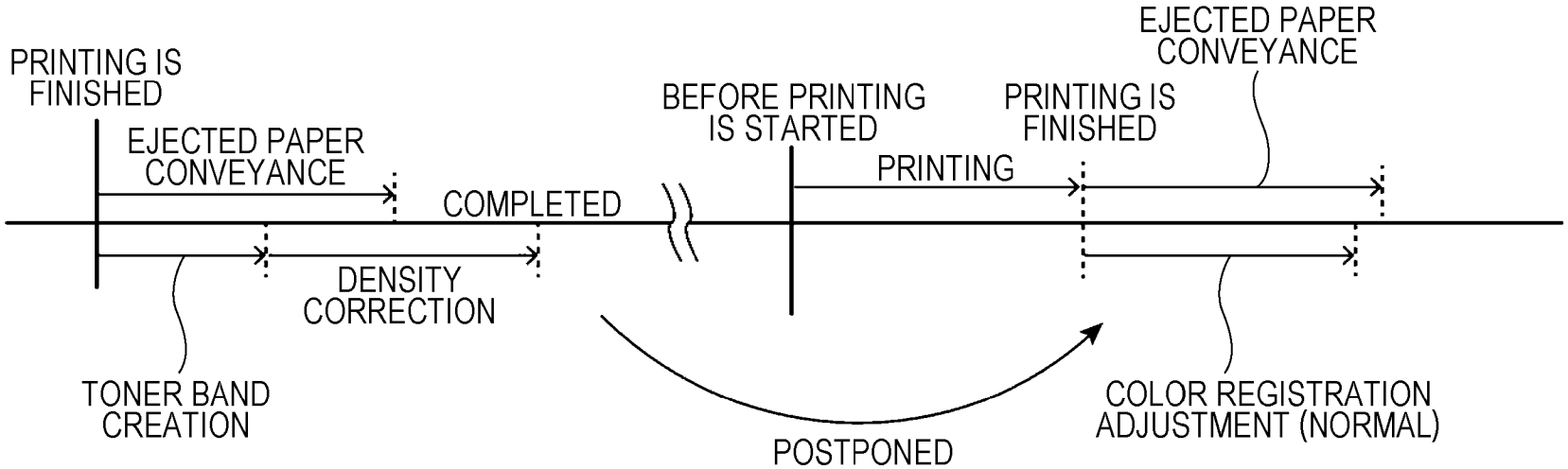
FIG. 7 is a view for illustrating an example in which the image quality adjusting operation not yet started when the conveyance of the continuous paper is stopped is postponed to the time when the next printing is finished.

FIG. 3 is a flowchart illustrating a procedure of a determining process when printing is finished. FIG. 4 is a flowchart illustrating a procedure of the determining process before the printing is started. FIG. 5 is a view for illustrating an example in which all the image quality adjusting operations are finished when the printing is finished. FIG. 6 is a view for illustrating an example in which the image quality adjusting operation which is not yet started when the conveyance of the continuous paper is stopped is postponed to the time when next printing is started. FIG. 7 is a view for illustrating an example in which the image quality adjusting operation which is not yet started when the conveyance of the continuous paper is stopped is postponed to the time when the next printing is finished.

First, the procedure of the determining process when the printing is finished is described with reference to FIG. 3.

(Determining Process when Printing is Finished)

For example, the image forming device 30 starts the determining process when the printing is finished illustrated in FIG. 3 when receiving a print job from the external device (such as the host device in which the printer driver is embedded) through the network I/F 74 and executing the printing. Timing at which the determining process when the printing is finished is started is not limited to this. For example, it is possible to start the determining process when the printing is finished when a paper document is put on an ADF (auto document feeder) or a platen, an operation to issue a copy instruction is performed on the operation panel 37, and the printing is executed.

[Step S101]

When the determining process when the printing is finished is started, the control unit 31 controls the image forming unit 33 to execute the image forming operation. For example, the control unit 31 extracts print target data included in the print job when this receives the print job from the external device. The control unit 31 controls the image forming unit 33 to form the toner image based on the print target data on the photoreceptor drums (Y, M, C, and K) of the respective colors and transfers the same to the continuous paper P through the intermediate transfer belt B. At that time, the transfer from the intermediate transfer belt B to the continuous paper P is performed by the application of the bias of the opposite polarity to the toner to the transfer roller (transfer unit) T. The control unit 31 at least controls the paper feed conveying unit 32 and the paper ejection conveying unit 36 to convey the continuous paper P in association with the above-described image forming operation. According to this, the toner image (image) based on the print target data is formed on the continuous paper P. Subsequently, the image formed on the continuous paper P is conveyed to a position of the fixing unit 35 and the heat and pressure are applied thereto by the fixing roller R1 and the pressurizing roller R2 of the fixing unit 35. As a result, the toner image (image) based on the print target data is melt-fixed to the continuous paper P. Meanwhile, when the copy instruction is issued by the operation panel 37, the control unit 31 may scan the paper document put on the ADF or the platen to print a generated scan image as the print target data by the operation similar to that described above.

When a plurality of print jobs is continuously received or when the data of a plurality of pages is included in the print target data, the control unit 31 forms the image for each page on the continuous paper P.

[Step S102]

The control unit 31 determines whether the image forming operation in step S101 is finished. Specifically, the control unit 31 determines whether the image of a last page (that is to say, the "last image") included in the print target data being printed is formed on the continuous paper P. When the last image is not yet formed, the control unit 31 determines that the image forming operation is not finished (No in step S102) and continuously performs the process in step S101. On the other hand, when the last image is already formed, the control unit 31 determines that the image forming operation is finished (Yes in step S102) and shifts to step S103.

[Step S103]

The control unit 31 determines whether the image quality adjusting operation is necessary. Specifically, the control unit 31 determines whether a predetermined execution condition is satisfied for each of a plurality of image quality adjusting operations (toner band creation, density correction, normal color registration adjustment, fine color registration adjustment and the like). For example, it is determined whether the number of images formed after the previous execution is not smaller than the predetermined number (for example, 500) as the execution condition of the toner band creation (execution condition 1). It is also determined whether difference in humidity from the previous execution is 10% or larger or whether the number of images formed after the previous execution is not smaller than the predetermined number (for example, 1000) as the execution condition of the density correction (execution condition 2). It is determined whether difference in temperature from the previous execution is 5 degrees C. or larger or whether the number of images formed after the previous execution is not smaller than the predetermined number (for example, 1500) as the execution condition of the normal color registration adjustment (execution condition 3). It is also determined whether the difference in temperature from the previous execution is 5 degrees C. or larger or whether predetermined time (for example, one hour) has passed after the previous execution time when the printing is started as the execution condition of the fine color registration adjustment (execution condition 4). In all the conditions, although the predetermined number and predetermined time are automatically set by a machine, they may be optionally set by a user.

When at least one of the execution conditions 1 to 4 is satisfied, the control unit 31 determines that the image quality adjusting operation is necessary (Yes in step S103) and shifts to step S104. On the other hand, when all the execution conditions 1 to 4 are not satisfied, the control unit 31 determines that the image quality adjusting operation is not necessary (No in step S103) and shifts to step S112.

[Step S104]

The control unit 31 separates the transfer roller (transfer unit) T from the continuous paper P. Subsequently, while the transfer roller T is maintained in a state separated from the continuous paper P, the image quality adjusting operation is executed. According to this, it is possible to inhibit adhesion of unnecessary toner to the continuous paper P.

[Step S105]

The control unit 31 executes the image quality adjusting operation the execution condition of which is satisfied. For example, when the "toner band creation" is executed as the image quality adjusting operation, the control unit 31 supplies a small amount of toner at predetermined intervals to the cleaning blade (not illustrated) arranged for cleaning the intermediate transfer belt B. When the "density correction" is executed as the image quality adjusting operation, the control unit 31 allows the reading unit 34 to read the patch and pattern for the image quality adjustment formed on the intermediate transfer belt B. The control unit 31 changes the process condition such as the exposure amount and the bias voltage of the image forming unit 33 based on the reading result (for example, the densities of the respective colors). Also when the "normal color registration adjustment" is executed as the image quality adjusting operation, the control unit 31 allows the reading unit 34 to read the patch and pattern for the image quality adjustment formed on the intermediate transfer belt B. The control unit 31 changes the position at which the irradiation of the laser light applied to the photoreceptor drums of the respective colors is started and the axis thereof based on the reading result (for example, the printing positions of the respective colors). Also when the "fine color registration adjustment" is executed as the image quality adjusting operation, the control unit 31 allows the reading unit 34 to read the patch and pattern for the image quality adjustment formed on the intermediate transfer belt B. The control unit 31 changes the position at which the irradiation of the laser light applied to the photoreceptor drums of the respective colors is started based on the reading result (for example, the printing positions of the respective colors).

When there is a plurality of image quality adjusting operations the execution conditions of which are satisfied, the control unit 31 sets execution order and then starts each image quality adjusting operation according to the execution order. For example, the control unit 31 sets the execution order of the image quality adjusting operations such that a more important image quality adjusting operation is preferentially executed while the last image formed on the continuous paper P by the image forming unit 33 is conveyed to arrive at a predetermined position (such as in the paper ejecting device 60). Meanwhile, in the example of this embodiment, the importance of the "toner band creation" required for avoiding a break of a cleaning member and an image quality defect (cleaning defect) is set to a high level. The importance of the "density correction" required for avoiding the density deviation is set to an intermediate level and the importance of the "normal color registration adjustment" and the "fine color registration adjustment" required for avoiding the color deviation is set to a low level. The levels of importance are illustrative only and may be appropriately changed.

In this embodiment, as an example, average time that elapses before the last image formed on the continuous paper P by the image forming unit 33 is conveyed to arrive at a predetermined position (hereinafter, referred to as "paper ejection conveying time") is set to 30 seconds. Average time required for the toner band creation is set to 10 seconds. Average time required for the density correction is set to 40 seconds. Average time required for the normal color registration adjustment is set to 50 seconds. Average time required for the fine color registration adjustment is set to 30 seconds. In this example, the control unit 31 sets the execution order of the image quality adjusting operations to first perform the toner band creation such that the more important image quality adjusting operation is preferentially executed within the paper ejection conveying time.

When the image quality adjusting operation the execution of which is postponed in the past is registered as the image quality adjusting operation which should be executed when current image formation is finished, the control unit 31 also executes the image quality adjusting operation. Meanwhile, the control unit 31 preferentially executes the image quality adjusting operation the execution of which is postponed when there is a plurality of image quality adjusting operations which should be executed.

[Step S106]

The control unit 31 determines whether to stop the conveyance while controlling the paper ejection conveying unit 36 to convey the continuous paper P. Specifically, an image sensor is arranged in a predetermined position in the paper ejecting device 60 and the control unit 31 detects that the last image (head or tail thereof) passes through a predetermined position based on a signal from the image sensor. When the image sensor does not detect passage of the last image (No in step S106), the control unit 31 continues to convey the continuous paper P. On the other hand, when the image sensor detects the passage of the last image (Yes in step S106), the control unit 31 stops conveying the continuous paper P.

[Step S107]

The control unit 31 determines whether there is a reservation of next image formation. For example, when the print target data not yet processed remains, the control unit 31 determines that there is the reservation of the next image formation. On the other hand, when there is no print target data, the control unit 31 determines that there is no reservation of the next image formation. When it is determined that there is the reservation of the next image formation (Yes in step S107), the control unit 31 shifts to step S108. On the other hand, when it is determined that there is no reservation of the next image formation (No in step S107), the control unit 31 shifts to step S111.

[Step S108]

The control unit 31 determines whether it is set to wait for all the image quality adjusting operations to be finished when the printing is finished. When it is set to wait for all the image quality adjusting operations to be finished (Yes in step S108), the control unit 31 shifts to step S111. On the other hand, when it is set not to wait for all the image quality adjusting operations to be finished (No in step S108), the control unit 31 shifts to step S109. Meanwhile, setting of whether to wait for all the image quality adjusting operations to be finished is registered in a predetermined storage device (for example, the storage 73) in advance before the determining process when the printing is finished is started.

[Step S109]

The control unit 31 determines whether the image quality adjusting operation started last is finished. When the image quality adjusting operation started last is not yet finished (No in step S109), the control unit 31 executes the image quality adjusting operation being executed to the end. On the other hand, when the image quality adjusting operation started last is finished (Yes in step S109), the control unit 31 shifts to step S110.

[Step S110]

When there is the image quality adjusting operation not yet started, the control unit 31 registers the same so as to postpone without executing. Specifically, identification information of the image quality adjusting operation not yet started (for example, a name of the image quality adjusting operation) is stored in a predetermined storage device (for example, the storage 73) as the image quality adjusting operation which should be executed when the image formation by the image forming unit 33 is newly started. It is also possible to store the identification information of the image quality adjusting operation not yet started in a predetermined storage device as the image quality adjusting operation which should be executed when next image formation by the image forming unit 33 is finished. After the process in step S110, the control unit 31 finishes the determining process when the printing is finished.

[Step S111]

The control unit 31 determines whether all the image quality adjusting operations the execution of which is determined to be necessary in step S103 are finished. When not all the image quality adjusting operations are finished (No in step S111), the control unit 31 waits for all the image quality adjusting operations to be finished. On the other hand, when all the image quality adjusting operations are finished (Yes in step S111), the control unit 31 directly finishes the determining process when the printing is finished.

[Step S112]

The control unit 31 determines whether to stop the conveyance while controlling the paper ejection conveying unit 36 to convey the continuous paper P. Specifically, the control unit 31 detects that the last image (head or tail thereof) passes through a predetermined position based on the signal from the image sensor arranged in a predetermined position in the paper ejecting device 60. When the image sensor does not detect the passage of the last image (No in step S112), the control unit 31 continues to convey the continuous paper P. On the other hand, when the image sensor detects the passage of the last image (Yes in step S112), the control unit 31 stops conveying the continuous paper P to finish the determining process when the printing is finished.

Next, the procedure of the determining process before the printing is started is described with reference to FIG. 4.

(Determining Process Before Printing is Started)

For example, if the image forming device 30 newly receives the print job from the external device through the network I/F 74 after the determining process when the printing is finished illustrated in FIG. 3 is executed, this starts the determining process before the printing is started illustrated in FIG. 4. Timing to start the determining process before the printing is finished is not limited to this. For example, it is possible that, after the determining process after the printing is finished illustrated in FIG. 3 is executed, the paper document is put on the ADF or the platen, operation to issue the copy instruction is performed on the operation panel 37, and the determining process before the printing is started.

[Step S201]

When the determining process before the printing is started is started, the control unit 31 determines whether the image quality adjusting operation a predetermined execution condition of which is newly satisfied is generated. Specifically, the control unit 31 determines whether the above-described execution conditions 1 to 4 are newly satisfied for each of a plurality of image quality adjusting operations (toner band creation, density correction, normal color registration adjustment, fine color registration adjustment and the like).

When at least one of the execution conditions 1 to 4 is newly satisfied, the control unit 31 determines that the image quality adjusting operation a predetermined execution condition of which is newly satisfied is generated (Yes in step S201) and shifts to step S202. On the other hand, when none of the execution conditions 1 to 4 is newly satisfied, the control unit 31 determines that the image quality adjusting operation a predetermined execution condition of which is newly satisfied is not generated (No in step S201) and shifts to step S203.

[Step S202]

The control unit 31 registers the image quality adjusting operation a predetermined execution condition of which is determined to be newly satisfied in step S201 as the image quality adjusting operation which should be executed when the image formation by the image forming unit 33 is newly started. Specifically, this stores the identification information of a target image quality adjusting operation (for example, the name of the image quality adjusting operation) in a predetermined storage device (for example, the storage 73).

[Step S203]

The control unit 31 determines whether there is the image quality adjusting operation which should be executed when the image formation is started. Specifically, the control unit 31 determines whether the identification information indicating the image quality adjusting operation which should be executed when the image formation is started is registered in a predetermined storage device. When this is registered, the control unit 31 determines that there is the image quality adjusting operation which should be executed when the image formation is started (Yes in step S203) and shifts to step S204. On the other hand, when this is not registered, the control unit 31 determines that there is no image quality adjusting operation which should be executed when the image formation is started (No in step S203), finishes the determining process before the printing is started, and starts the determining process when the printing is finished illustrated in FIG. 3.

[Step S204]

The control unit 31 executes the image quality adjusting operation registered as the image quality adjusting operation which should be executed when the current image formation is started. When there is a plurality of image quality adjusting operations which should be executed, the control unit 31 sets the execution order such that the more important image quality adjusting operation is preferentially executed and then starts each image quality adjusting operation according to the execution order. However, it is configured that the image quality adjusting operation postponed without being executed in step S110 described above is executed with first priority even when this is the image quality adjusting operation the importance of which is set to the low level.

[Step S205]

The control unit 31 determines whether all the image quality adjusting operations which should be executed are finished. When not all the image quality adjusting operations are finished (No in step S205), the control unit 31 waits for all the image quality adjusting operations to be finished. On the other hand, when all the image quality adjusting operations are finished (Yes in step S205), the control unit 31 finishes the determining process before the printing is started and starts the determining process when the printing is finished illustrated in FIG. 3.

The determining process when the printing is finished (FIG. 3) and the determining process before the printing is started (FIG. 4) described above are executed by the image forming device 30. In the determining process when the printing is finished, the image quality adjusting operation for adjusting the image quality is started (step S105) after the image is formed on the continuous paper P (step S101) and before the conveyance of the continuous paper P is stopped (step S106). That is to say, the conveyance of the continuous paper P after the image is formed and the image quality adjusting operation are performed in parallel. According to this, at least apart of the required image quality adjusting operations is finished while the conveyance of the continuous paper P after the image is formed is waited, so that it is possible to shorten down-time occurring when the continuous paper P is used as the recording medium and improve productivity.

In the determining process when the printing is finished, when there is no reservation of the next image formation (No in step S107), all the image quality adjusting operations predetermined execution conditions of which are satisfied are finished when the printing is finished (step S111). For example, as illustrated in FIG. 5, when the image quality adjusting operations predetermined execution conditions of which are satisfied are the toner band creation, the density correction, and the normal color registration adjustment, the control unit 31 continuously performs to finish all the image quality adjusting operations even after the conveyance of the continuous paper P by the paper ejection conveying unit 36 is stopped. Therefore, in this case, even when there is the image quality adjusting operation not yet started when the conveyance of the continuous paper P by the paper ejection conveying unit 36 is stopped, this is not postponed to the time when the next printing is started. Therefore, it is possible to minimize the image quality adjusting operation executed when the next printing is started and rapidly start the printing operation when the print job is newly received and the like. Meanwhile, the fine color registration adjustment in FIG. 5 is the image quality adjusting operation newly generated when the printing is started (step S201).

In the determining process when the printing is finished, when there is the reservation of the next image formation (Yes in step S107) and it is set not to wait for all the image quality adjusting operations to be finished (No in step S108), the image quality adjusting operation not yet started is postponed without being executed (step S110). As in the example illustrated in FIG. 6, when the image quality adjusting operations predetermined execution conditions of which are satisfied are the toner band creation, the density correction, and the normal color registration adjustment, the control unit 31 may postpone the normal color registration adjustment not yet started when the conveyance of the continuous paper P is stopped to the time when the next printing is started. According to this, the postponed image quality adjusting operation is surely executed when the next printing is started.

It is also possible to postpone the image quality adjusting operation not yet started when the conveyance of the continuous paper P is stopped not to the time when the next printing is started but to the time when the next printing is finished. As in the example illustrated in FIG. 7, when the image quality adjusting operations predetermined execution conditions of which are satisfied are the toner band creation, the density correction, and the normal color registration adjustment, the control unit 31 may postpone the normal color registration adjustment not yet started when the conveyance of the continuous paper P is stopped to the time when the next printing is finished. According to this, the postponed image quality adjusting operation is surely executed when the next printing is finished. It is also possible to minimize the image quality adjusting operation executed when the printing is started and rapidly start the printing operation when the print job is newly received and the like.

In the determining process before the printing is started, it is determined again whether the image quality adjusting operation a predetermined execution condition of which is newly satisfied is generated when the printing is started (step S201). According to this, it is possible to appropriately execute the required image quality adjusting operation according to change in usage condition of the image forming system 1.

Meanwhile, each processing unit of each flowchart described above is obtained by dividing according to main processing contents for easier comprehension of the image forming system 1. The invention of the present application is not limited by a classification method of processing steps and names thereof. The process performed by the image forming system 1 may be divided into more processing steps. One processing step may execute more processes.

<Variation>

The above-described embodiment is intended to illustrate the gist of the present invention and does not limit the present invention. Many alternatives, modifications, and variations are obvious for one skilled in the art.

For example, in the above-described embodiment, the image forming device 30 adopts a tandem type having a plurality of photoreceptor drums (Y, M, C, and K) and the intermediate transfer belt B as the image carrying bodies. However, the present invention is not limited to this and may be a rotary type in which single photoreceptor drum is used as the image carrying body.

In the above-described embodiment, when there is a plurality of image quality adjusting operations the execution conditions of which are satisfied, the execution order is set and then each image quality adjusting operation is started according to the execution order. The execution order of the image quality adjusting operations may be variously modified.

Specifically, the image quality adjusting operations may be performed in rotation such that they are executed in a balanced manner in terms of execution intervals. For example, when the toner band creation and the normal color registration adjustment are executed after the first printing is finished, the image quality adjusting operation which is not executed when the first printing is finished (such as the density correction) is preferentially executed after the second printing is finished as far as possible.

It is also possible that a part of the image quality adjusting operations is not performed in rotation and other image quality adjusting operations are performed in rotation.

Although the toner band creation, the density correction, the normal color registration adjustment, and the fine color registration adjustment are described as the example of the image quality adjusting operation in the above-described embodiment, the operation is not limited to them.

A main configuration is described for describing characteristics of the above-described embodiment and variation as the configuration of the image forming system 1 described above, and this is not limited to the above-described configuration. This does not exclude the configuration of a general image forming system 1.

The process of the control unit 31 described above may also be realized by a dedicated hardware circuit. In this case, this may be executed by a piece of hardware or a plurality of pieces of hardware.

A program which allows the image forming system 1 to operate may be provided by a computer readable recording medium such as a USB memory, a flexible disk, and a CD-ROM or may be provided online through a network such as the Internet. In this case, the program recorded on the computer readable recording medium is transferred to be stored in the memory 72, the storage 73 and the like in general. The program may be provided as single application software or may be embedded in software as a function of the image forming system 1, for example.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming device comprising:

an image forming unit configured to continuously form images on continuous paper;

a conveying unit configured to convey the continuous paper; and a control unit configured to start an image quality adjusting operation for adjusting image quality of a subsequent image to be formed by the image forming unit after formation of a last image by the image forming unit is completed while the conveying unit conveys the continuous paper until the last image arrives at a predetermined position;

wherein, when the image quality adjusting operation is being executed when the last image arrives at the predetermined position and conveyance of the continuous paper is stopped, the control unit completely executes the image quality adjusting operation and postpones an image quality adjusting operation not yet started without executing the image quality adjusting operation not yet started.

2. The image forming device according to claim 1, wherein the control unit executes the image quality adjusting operation by controlling the image forming unit.

3. The image forming device according to claim 1, wherein the control unit executes at least one of toner band creation, density correction, and color registration adjustment as the image quality adjusting operation.

4. The image forming device according to claim 1, wherein the control unit determines whether a predetermined execution condition is satisfied for each of a plurality of image quality adjusting operations and executes the image quality adjusting operation when the predetermined execution condition is satisfied.

5. The image forming device according to claim 1, wherein the control unit executes the image quality adjusting operation the execution of which is postponed when image formation by the image forming unit is newly started.

6. The image forming device according to claim 5, wherein the control unit preferentially executes the image quality adjusting operation the execution of which is postponed when there are a plurality of image quality adjusting operations which should be executed.

7. The image forming device according to claim 1, wherein the control unit executes the image quality adjusting operation the execution of which is postponed when next image formation by the image forming unit is finished.

8. An image forming method for an image forming device comprising an image forming unit including a transfer unit configured to transfer an image from an image carrying body to continuous paper, said method comprising:

continuously forming images on the continuous paper;

conveying the continuous paper; and starting an image quality adjusting operation for adjusting image quality of a subsequent image to be formed by the image forming unit after formation of a last image by the image forming unit is completed while the continuous paper is conveyed until the last image arrives at a predetermined position;

wherein, when the image quality adjusting operation is being executed when the last image arrives at the predetermined position and conveyance of the continuous paper is stopped, the image quality adjusting operation is completely executed and an image quality adjusting operation not yet started is postponed without executing the image quality operation not yet started.

9. The image forming method according to claim 8, wherein the image quality adjusting operation is executed by controlling the image forming unit.

10. The image forming method according to claim 8, wherein the the image quality adjusting operation includes at least one of toner band creation, density correction, and color registration adjustment.

11. The image forming method according to claim 8, further comprising determining whether a predetermined execution condition is satisfied for each of a plurality of image quality adjusting operations, and executing the image quality adjusting operation when the predetermined execution condition is satisfied.

12. The image forming method according to claim 8, wherein the image quality adjusting operation the execution of which is postponed is executed when image formation by the image forming unit is newly started.

13. The image forming method according to claim 12, wherein the image quality adjusting operation the execution of which is postponed is preferentially executed when there are a plurality of image quality adjusting operations which should be executed.

14. The image forming method according to claim 8, wherein the image quality adjusting operation the execution of which is postponed is executed when next image formation by the image forming unit is finished.

15. An image forming method for an image forming device comprising an image forming unit including a transfer unit configured to transfer an image from an image carrying body to continuous paper, said method comprising:

continuously forming images on the continuous paper;

conveying the continuous paper; and starting an image quality adjusting operation for adjusting image quality of a subsequent image to be formed by the image forming unit after formation of a last image by the image forming unit is completed while the continuous paper is conveyed until the last image arrives at a predetermined position;

wherein, when next image formation is reserved and the image quality adjusting operation is being executed when the last image arrives at the predetermined position and conveyance of the continuous paper is stopped, the image quality adjusting operation is completely executed and an image quality adjusting operation not yet started is postponed without executing the image quality operation not yet started.

16. A non-transitory recording medium storing a computer readable program for controlling an image forming device comprising an image forming unit including a transfer unit configured to transfer an image from an image carrying body to continuous paper, said program controlling the image forming device to execute operations of:

continuously forming images on continuous paper;

conveying the continuous paper; and starting an image quality adjusting operation for adjusting image quality of a subsequent image to be formed by the image forming unit after formation of a last image by the image forming unit is completed while the continuous paper is conveyed until the last image arrives at a predetermined position;

wherein, when the image quality adjusting operation is being executed when the last image arrives at the predetermined position and conveyance of the continuous paper is stopped, the image quality adjusting operation is completely executed and an image quality adjusting operation not yet started is postponed without executing the image quality operation not yet started.

17. The non-transitory recording medium according to claim 16, wherein the image quality adjusting operation is executed by controlling the image forming unit.

18. The non-transitory recording medium according to claim 16, wherein the the image quality adjusting operation includes at least one of toner band creation, density correction, and color registration adjustment.

19. The non-transitory recording medium according to claim 16, wherein said program further controls the image forming device to execute an operation of determining whether a predetermined execution condition is satisfied for each of a plurality of image quality adjusting operations, and executes the image quality adjusting operation when the predetermined execution condition is satisfied.

20. The non-transitory recording medium according to claim 16, wherein the image quality adjusting operation the execution of which is postponed is executed when image formation by the image forming unit is newly started.

21. The non-transitory recording medium according to claim 20, wherein the image quality adjusting operation the execution of which is postponed is preferentially executed when there are a plurality of image quality adjusting operations which should be executed.

22. The non-transitory recording medium according to claim 16, wherein the image quality adjusting operation the execution of which is postponed is executed when next image formation by the image forming unit is finished.

23. A non-transitory recording medium storing a computer readable program for controlling an image forming device comprising an image forming unit including a transfer unit configured to transfer an image from an image carrying body to continuous paper, said program controlling the image forming device to execute operations of:

continuously forming images on continuous paper;

conveying the continuous paper; and starting an image quality adjusting operation for adjusting image quality of a subsequent image to be formed by the image forming unit after formation of a last image by the image forming unit is completed while the continuous paper is conveyed until the last image arrives at a predetermined position;

wherein, when next image formation is reserved and the image quality adjusting operation is being executed when the last image arrives at the predetermined position and conveyance of the continuous paper is stopped, the image quality adjusting operation is completely executed and an image quality adjusting operation not yet started is postponed without executing the image quality operation not yet started.

24. An image forming device comprising:

an image forming unit configured to continuously form images on continuous paper;

a conveying unit configured to convey the continuous paper; and a control unit configured to start an image quality adjusting operation for adjusting image quality of a subsequent image to be formed by the image forming unit after formation of a last image by the image forming unit is completed while the conveying unit conveys the continuous paper until the last image arrives at a predetermined position;

wherein, when next image formation is reserved and the image quality adjusting operation is being executed when the last image arrives at the predetermined position and conveyance of the continuous paper is stopped, the control unit completely executes the image quality adjusting operation and postpones the image quality adjusting operation not yet started without executing the image quality adjusting operation not yet started.

* * * * *